US008638346B2

(12) United States Patent
Woo et al.

(10) Patent No.: US 8,638,346 B2
(45) Date of Patent: Jan. 28, 2014

(54) SOURCE LINE DRIVER CIRCUIT AND DISPLAY APPARATUS INCLUDING THE SAME

(75) Inventors: Jae Hyuck Woo, Osan-si (KR); Jae Goo Lee, Yongin-si (KR); Won Sik Kang, Seoul (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 929 days.

(21) Appl. No.: 12/585,840

(22) Filed: Sep. 25, 2009

(65) Prior Publication Data

US 2010/0079505 A1 Apr. 1, 2010

(30) Foreign Application Priority Data

Sep. 30, 2008 (KR) ..... 10-2008-0095727

(51) Int. Cl.
*G09G 5/10* (2006.01)

(52) U.S. Cl.
USPC ..... 345/690; 345/212; 345/214; 345/211; 345/204; 345/104; 345/98; 345/87

(58) Field of Classification Search
None
See application file for complete search history.

(56) References Cited

U.S. PATENT DOCUMENTS

| | | | | |
|---|---|---|---|---|
| 6,914,614 | B2 * | 7/2005 | Kobayashi | 345/600 |
| 2007/0200816 | A1 | 8/2007 | Taguchi | |
| 2009/0058889 | A1 * | 3/2009 | Nishimura | 345/690 |

FOREIGN PATENT DOCUMENTS

| | | |
|---|---|---|
| JP | 2006-173779 | 6/2006 |
| JP | 2007-232977 | 9/2007 |
| KR | 10-2006-0030403 | 4/2006 |

* cited by examiner

*Primary Examiner* — Joseph Haley
*Assistant Examiner* — Ifedayo Iluyomade
(74) *Attorney, Agent, or Firm* — Harness, Dickey & Pierce, P.L.C.

(57) ABSTRACT

A source line driver circuit and a display apparatus including the same are provided. The source line driver circuit includes a logic block configured to receive serialized image data, to change the number of bits of the image data, and to output image data having the changed number of bits, and a source channel driver unit configured to receive the image data having the changed number of bits and to provide at least one analog voltage corresponding to the received image data to source lines. Accordingly, the number of necessary switches may be reduced, and therefore, the required area and/or current consumption may also be reduced.

10 Claims, 11 Drawing Sheets

FIG. 2

| D<1> | D<0> | PD01<0> | PD01<1> | PD01<2> | PD01<3> |
|---|---|---|---|---|---|
| 0 | 0 | 1 | 0 | 0 | 0 |
| 0 | 1 | 0 | 1 | 0 | 0 |
| 1 | 0 | 0 | 0 | 1 | 0 |
| 1 | 1 | 0 | 0 | 0 | 1 |

BEFORE CHANGE

AFTER CHANGE

SOURCE LINE DRIVER CIRCUIT AND DISPLAY APPARATUS INCLUDING THE SAME

CROSS-REFERENCE TO RELATED APPLICATIONS

This U.S. non-provisional application claims priority under 35 U.S.C. §119(e) to Korean Patent Application No. 10-2008-0095727 filed on Sep. 30, 2008, the entire contents of which are incorporated herein by reference.

BACKGROUND

1. Field

Example embodiments relate to source line driving technology (e.g., source line driver circuits for reducing an occupying area and/or current consumption by reducing the number of switches implemented in a decoder).

2. Description of Conventional Art

A conventional thin film transistor liquid crystal display (TFT-LCD) device may be a representative flat panel display device used in televisions (TVs), monitors, and/or cellular phones. A display driver IC (DDI), used in the conventional TFT-LCD, may drive a plurality of source lines and/or a plurality of gate lines in the conventional TFT-LCD using a decoder, such that the TFT-LCD may display an image through a plurality of pixels.

The decoder of the DDI may include a plurality of transmission switches operating in response to image data. The number of transmission switches may be closely related with a chip's area and/or current consumption. Therefore, an approach for reducing the number of transmission switches is desired.

SUMMARY

Example embodiments provide a source line driver circuit for reducing an occupying area and/or current consumption by reducing the number of switches therein and a display apparatus including the same.

In an example embodiment, a source line driver circuit may include a logic block and a source channel driver unit. The logic block may be configured to receive serialized image data, to change the number of bits of the image data, and to output image data having the changed number of bits. The source channel driver unit may be configured to receive the image data having the changed number of bits and to provide at least one analog voltage corresponding to the received image data to source lines.

According to further example embodiments, a display apparatus may include a display panel and a panel driver. The display panel may include a plurality of scan lines and a plurality of source lines. The panel driver may include a source line driver circuit for driving the source lines. The source line driver circuit may include a logic block and a source channel driver unit. The logic block may be configured to receive serialized image data, to change the number of bits of the image data, and to output image data having the changed number of bits. The source channel driver unit may be configured to receive the image data having the changed number of bits and to provide at least one analog voltage corresponding to the received image data to source lines.

BRIEF DESCRIPTION OF THE DRAWINGS

The accompanying figures are included to provide a further understanding of example embodiments, and are incorporated and constitute part of this specification:

FIG. 2 is a table for explaining how a logic block illustrated in FIGS. 1A through 1C changes bits of image data;

DETAILED DESCRIPTION OF EXAMPLE EMBODIMENTS

Figure 1A:
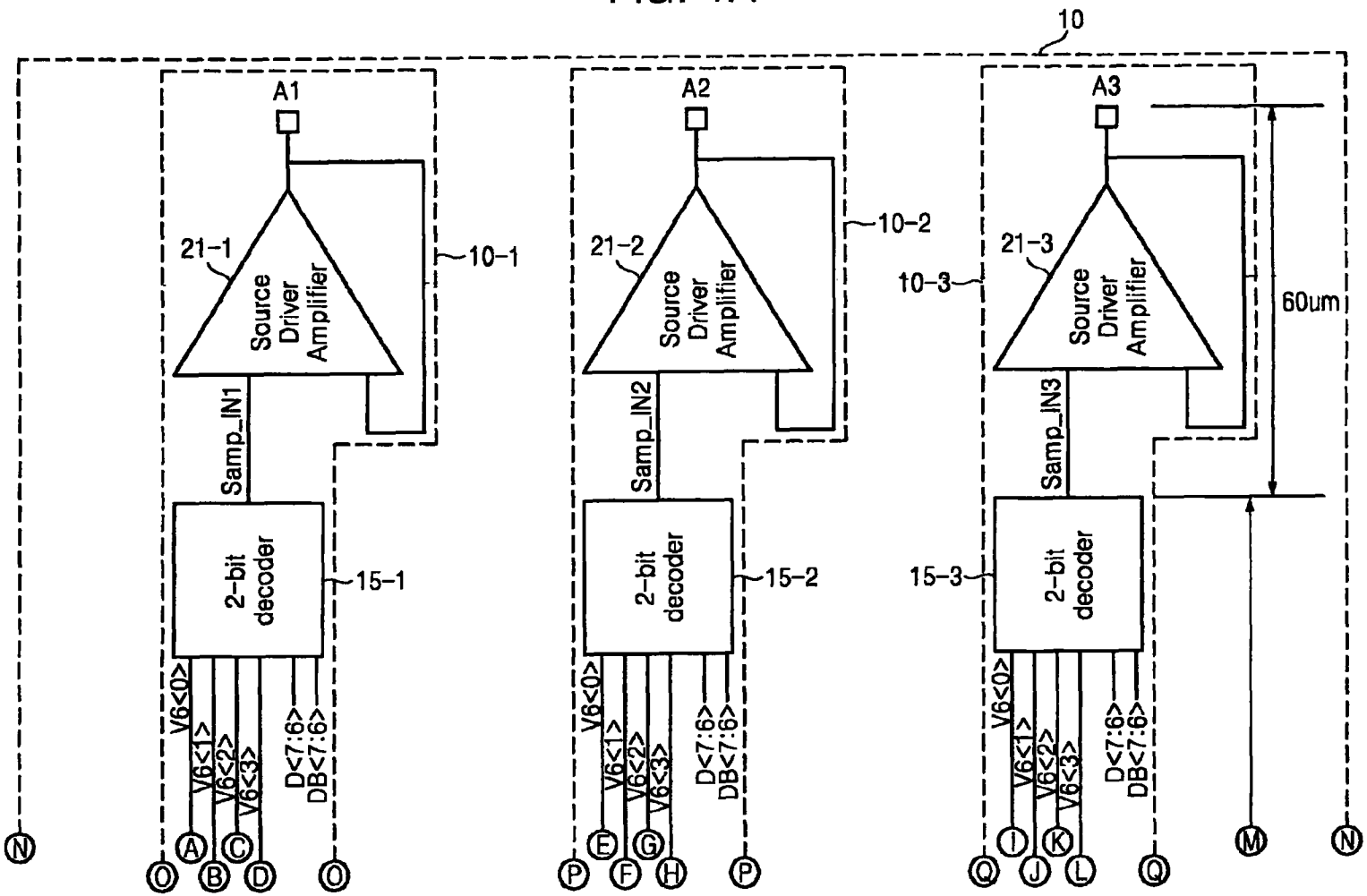
FIGS. 1A through 1C are block diagrams illustrating a source line driver circuit according to example embodiments.

Example embodiments will be described more fully hereinafter with reference to the accompanying drawings, in which example embodiments are shown. Example embodiments, however, be embodied in many different forms and should not be construed as limited to the embodiments set forth herein. Rather, these embodiments are provided so that this disclosure will be thorough and complete, and will fully convey the scope of example embodiments to those skilled in the art. In the drawings, the size and relative sizes of layers and regions may be exaggerated for clarity and like numbers refer to like elements throughout.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. As used herein, the term "and/or" includes any and all combinations of one or more of the associated listed items and may be abbreviated as "/".

It will be understood that, although the terms "first," "second," etc. may be used herein to describe various elements, components, regions, layers and/or sections, these elements, components, regions, layers and/or sections should not be limited by these terms. These terms are only used to distinguish one element, components, regions, layers and/or sections from another element, components, regions, layers and/or sections. For example, a first element, component, region, layer or section could be termed a second element, component, region, layer or section, and, similarly, a second element, component, region, layer or section could be termed a first element, component, region, layer or section without departing from the teachings of the disclosure.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of example embodiments. As used herein, the singular forms "a", "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Example embodiments are described herein with reference to cross-sectional illustrations that are schematic illustrations of idealized embodiments (and intermediate structures) of example embodiments. As such, variations from the shapes of the illustrations as a result, for example, of manufacturing techniques and/or tolerances, are to be expected. Thus, example embodiments should not be construed as limited to the particular shapes of regions illustrated herein but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of example embodiments.

Unless otherwise defined, all terms (including technical and scientific terms) used herein have the same meaning as commonly understood by one of ordinary skill in the art to which example embodiments belongs. It will be further understood that terms, such as those defined in commonly used dictionaries, should be interpreted as having a meaning that is consistent with their meaning in the context of the relevant art and/or the present application, and will not be interpreted in an idealized or overly formal sense unless expressly so defined herein.

Figure 1B:
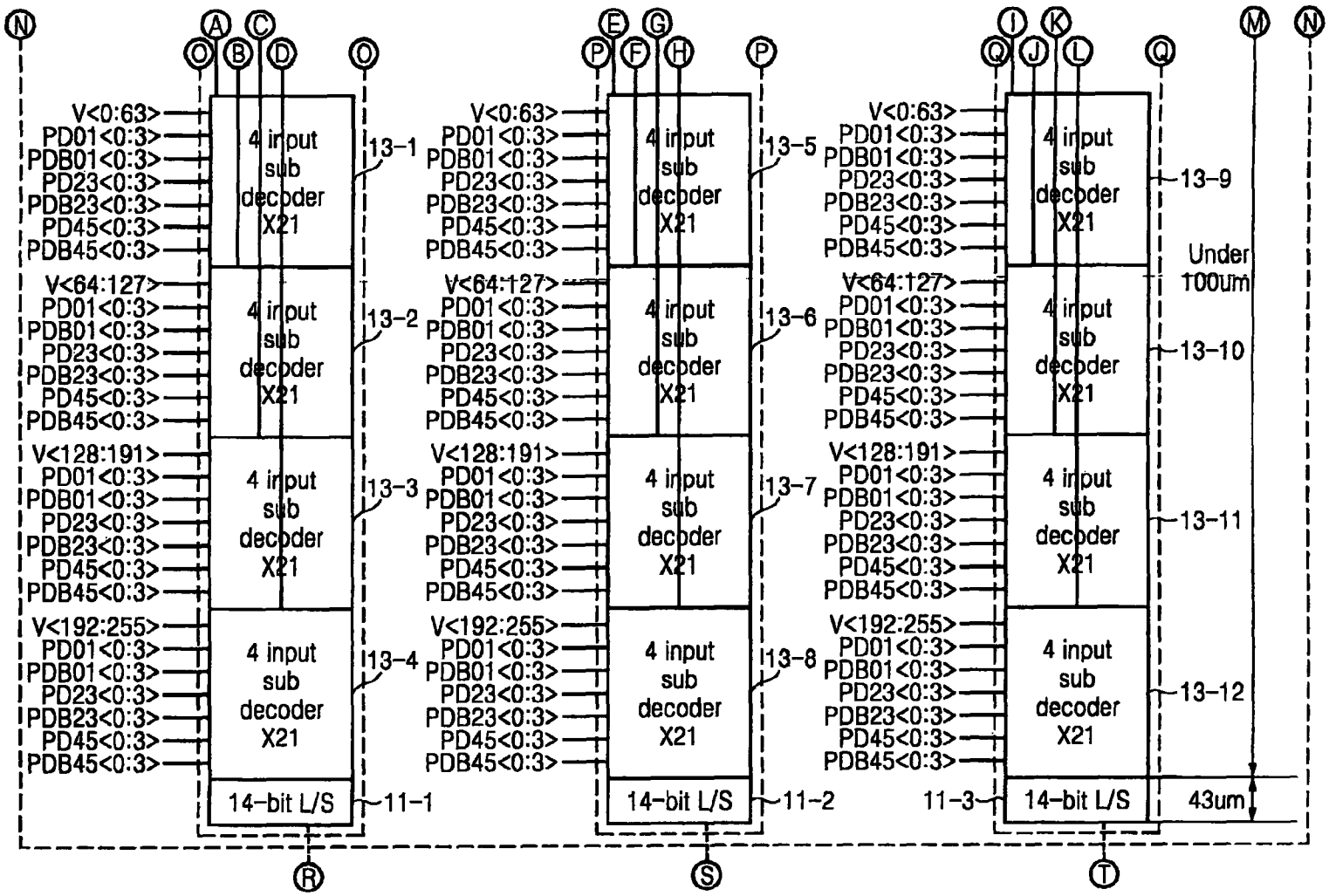
Figure 1C:
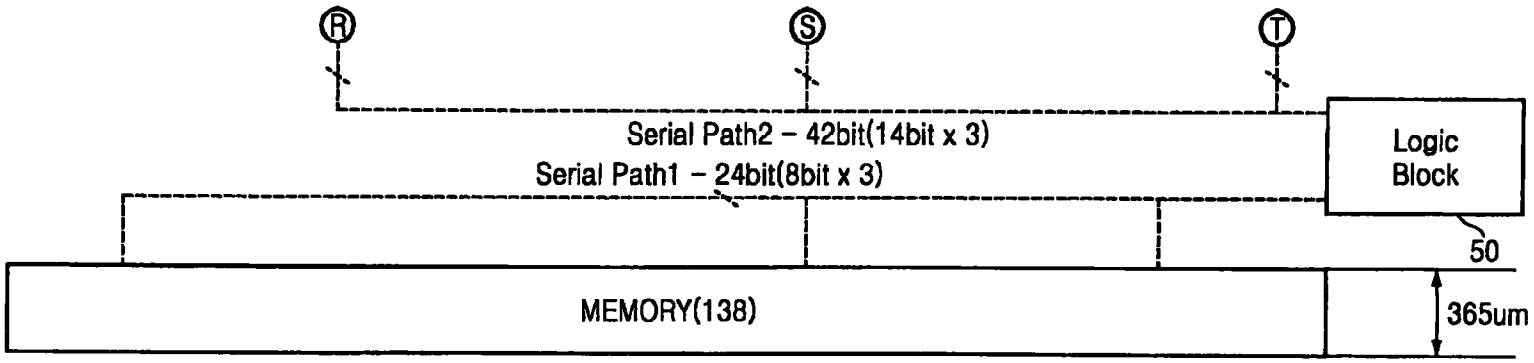

FIGS. 1A through 1C illustrate a source line driver circuit according to example embodiments. Referring to FIGS. 1A through 1C, a source driver, a data line driver, and/or the source line driver circuit, include a logic block 50 and a source channel driver unit (or a channel data driver unit) 10. The source driver, data line driver, and/or source line driver circuit may be used in a mobile phone, a personal digital assistant (PDA), and/or a portable multimedia player (PMP). The source channel driver unit 10 is illustrated in two parts FIGS. 1A and 1B. The logic block 50 is illustrated in FIG. 1C.

The logic block 50 may (i) receive serialized image data output from the memory unit 138 through a first transmission line (or a first bus) Serial Path1, (ii) change the number of bits of the image data, and/or (iii) output the image data having the changed number of bits through a second transmission line (or a second bus) Serial Path2. The image data may be R data, G data, or B data.

For instance, the logic block 50 may receive serialized first image data (e.g., R data) having N (which is a natural number, e.g., 8) bits from the memory unit 138 through the first transmission line Serial Path1, change the number of bits of the first image data, and/or output second image data having the changed number of bits, e.g., M (which is a natural number, e.g., 14) bits through the second transmission line Serial Path2. The first image data may be image data input to one source channel driver (e.g., 10-1) among a plurality of source channel drivers 10-1 through 10-3 included in the source channel driver unit 10.

FIG. 2 is a table for explaining how the logic block 50 illustrated in FIG. 1C changes bits of image data. When the first image data has N bits, e.g., 8 bits, the logic block 50 may change 2 bits (e.g., first and second bits D<0> and D<1>) among the 8 bits into 4 bits PD01<0> through PD01<3>. Referring back to FIGS. 1B-1C, in the same manner, the logic block 50 may change third and/or fourth bits of the first image data of 8 bits into 4 bits PD23<0> through PD23<3>, and/or fifth and sixth bits thereof into 4 bits PD45<0> through PD45<3>. The logic block 50 may output seventh and eighth bits D<7:6> of the first image data without changing them.

According to example embodiments, when changing the number of bits of the first image data (the first image data having 8 bits), 2 bits may be changed into 4 bits or 4 bits may be changed into 16 bits, and/or the number of bits may be changed in other various ways. In the example embodiments, the logic block 50 may change the first image data of 8 bits into the second image data of 14 bits and/or output the second image data to a corresponding source channel driver, e.g., 10-1, among the source channel drivers 10-1 through 10-3. Each of the bits PD01<0> through PD01<3>, PD23<0> through PD23<3>, PD45<0> through PD45<3>, and D<7:6> of the second image data may be used as a switching signal for selecting one gray-scale voltage among a plurality of gray-scale voltages and/or may be level-shifted by a level shifter, e.g., 11-1.

The logic block 50 may include a circuit (not shown) to drive a liquid crystal in a display panel (e.g., 120 in FIG. 7) with alternating current (AC). The circuit may be an M/AC circuit. An output signal of the M/AC circuit may be used as a selection signal (or a switching signal) for allowing the source channel drivers 10-1 through 10-3 to select one gray-scale voltage among a plurality of gray-scale voltages V<0> through V<255>. In addition, when transmitting image data having the changed number of bits to the source channel drivers 10-1 through 10-3, the logic block 50 may perform content adaptive brightness control (CABC) to automatically control the brightness of the panel.

Returning to FIGS. 1A-1C, the source channel driver unit 10 may receive serialized image data from the logic block 50 and/or output analog voltages A1 through A3 corresponding to the received image data. The source channel driver unit 10 may include a plurality of the source channel drivers 10-1 through 10-3. Each of the source channel drivers 10-1 through 10-3 may receive 14-bit image data (e.g., R, G, or B data) from the logic block 50.

Each of the source channel drivers 10-1 through 10-3 may receive corresponding M (e.g., 14) bit second image data in M×3 (e.g., 42) bit second image data output from the logic block 50 and/or provide an analog voltage corresponding to N (e.g., 8) bit first image data to a source line (not shown) based on the bits (or bit levels) of the received second image data. For instance, among the source channel drivers 10-1 through 10-3, the first source channel driver 10-1 may select one gray-scale voltage Samp_IN1 among a plurality of gray-scale voltages, e.g., V<0:255>, based on at least one bit (or bit level) among the, e.g., M (e.g., 14) bits or bit levels of the second image data received from the logic block 50 and/or may provide an analog voltage A1 corresponding to the first image data to a source line (not shown).

The source channel drivers 10-1 through 10-3 may be formed using level shifters 11-1 through 11-3, sub decoding blocks 13-1 through 13-12, decoders 15-1 through 15-3, and source driver amplifiers 21-1 through 21-3. For instance, the first source channel driver 10-1 may include the level shifter 11-1, the sub decoding blocks 13-1 through 13-4, the decoder 15-1, and the source driver amplifier 21-1.

The level shifter 11-1 may shift the level of a signal of the second image data received from the logic block 50 to output level-shifted signals, e.g., PD01<0:3>, PD23<0:3>, and/or PD45<0:3>. In addition, the level shifter 11-1 may invert the level-shifted signals PD01<0:3>, PD23<0:3>, and PD45<0:3> to output inverted signals PDB01<0:3>, PDB23<0:3>, and/or PDB45<0:3>. Although a signal level of each bit of the second image data is shifted by the level shifter 11-1 in the example embodiments, the second image data may be directly input to the sub decoding blocks 13-1 through 13-4 without being level-shifted in other embodiments.

Each of the sub decoding blocks 13-1 through 13-4 may output at least one gray-scale voltage V6<0>, V6<1>, V6<2>, or V6<3> among the plurality of gray-scale voltages V<0:255> in response to the bits (or the signal levels of the bits) of the second image data or the output bits of the level shifter 11-1 (hereinafter, referred to as "first group output bits", e.g., PD01<0:3>, PDB01<0:3>, PD23<0:3>, PDB23<0:3>, PD45<0:3>, and/or PDB45<0:3>).

Among the sub decoding blocks 13-1 through 13-4, the first sub decoding block 13-1 may select and/or output the first gray-scale voltage V6<0> among first group gray-scale voltages V<0:63> in response to the first group output bits PD01<0:3>, PDB01<0:3>, PD23<0:3>, PDB23<0:3>, PD45<0:3>, and/or PDB45<0:3>. The second sub decoding block 13-2 may select and/or output the second gray-scale voltage V6<1> among second group gray-scale voltages V<64:127> in response to the first group output bits PD01<0:3>, PDB01<0:3>, PD23<0:3>, PDB23<0:3>, PD45<0:3>, and/or PDB45<0:3>. The third sub decoding block 13-3 may select and/or output the third gray-scale voltage V6<2> among third group gray-scale voltages V<128:191> in response to the first group output bits PD01<0:3>, PDB01<0:3>, PD23<0:3>, PDB23<0:3>, PD45<0:3>, and/or PDB45<0:3>. The fourth sub decoding block 13-4 may select and/or output the fourth gray-scale voltage V6<3> among fourth group gray-scale voltages V<192:255> in response to the first group output bits PD01<0:3>, PDB01<0:3>, PD23<0:3>, PDB23<0:3>, PD45<0:3>, and/or PDB45<0:3>.

Figure 3:
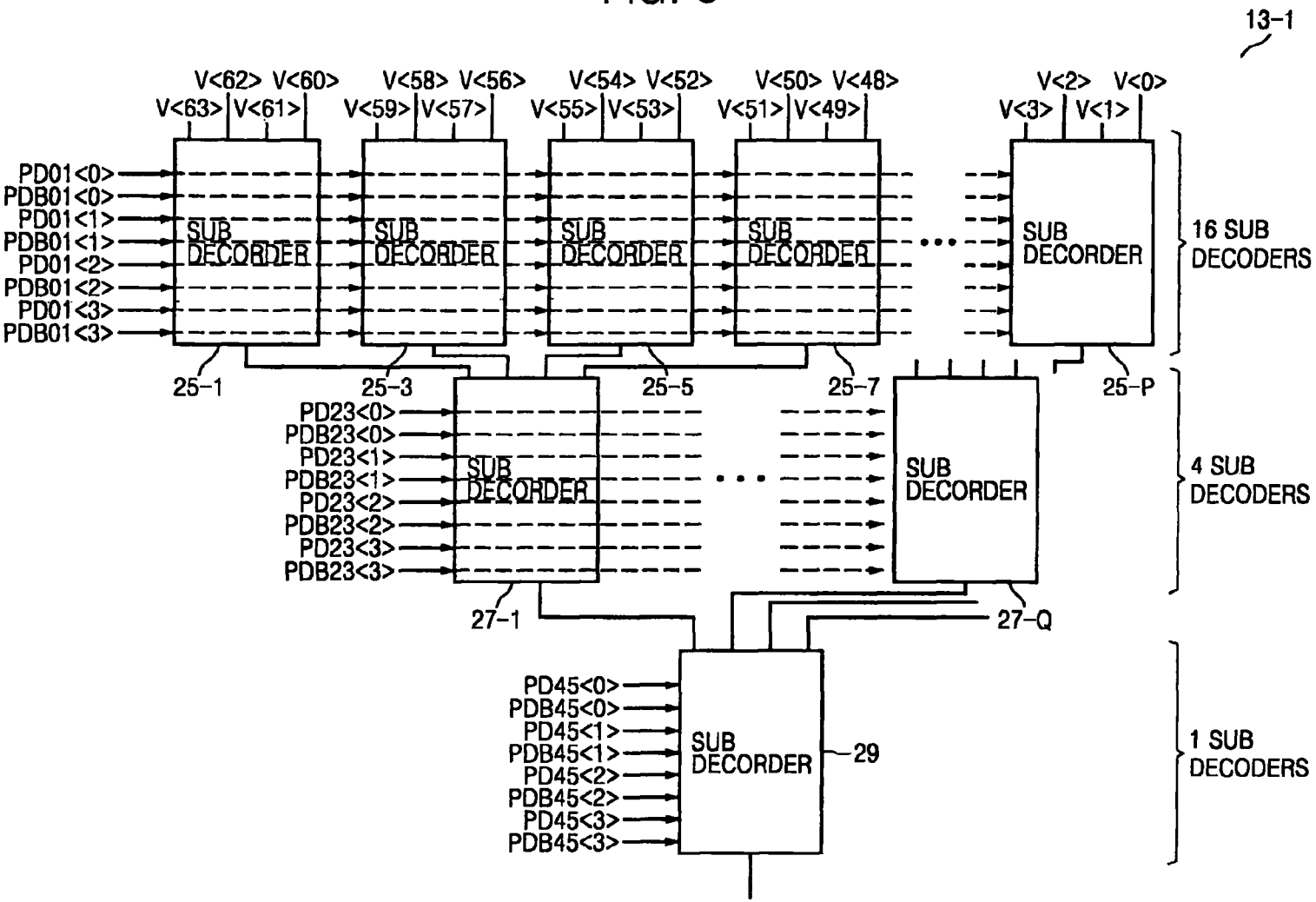
FIG. 3 is a block diagram of a sub decoding block illustrated in FIGS. 1A through 1C.

FIG. 3 is a block diagram of the sub decoding block 13-1 illustrated in FIGS. 1A through 1C. Since the other sub decoding blocks 13-2 through 13-4 have the same structure and/or functions as the sub decoding block 13-1, detailed descriptions thereof will be omitted. Referring to FIGS. 1A through 1C and FIG. 3, the sub decoding block 13-1 may include a plurality of sub decoders 25-1 through 25-P, 27-1 through 27-Q, and 29. Each of the sub decoders 25-1 through 25-P, 27-1 through 27-Q, and 29 may select and/or output one voltage among a plurality of gray-scale voltages, e.g., V<0:63>, in response to some bits among the first group output bits PD01<0:3>, PDB01<0:3>, PD23<0:3>, PDB23<0:3>, PD45<0:3>, and/or PDB45<0:3>.

In detail, the sub decoders 25-1 through 25-P, 27-1 through 27-Q, and 29 may be divided into first group sub decoders 25-1 through 25-P, second group sub decoders 27-1 through 27-Q, and a third group sub decoder 29.

Each of the first group sub decoders 25-1 through 25-P may receive S (which is a natural number, e.g., 4) gray-scale voltages among the gray-scale voltages V<0:63> and select and/or output one gray-scale voltage among the four gray-scale voltages in response to the first bits PD01<0:3> and/or PDB01<0:3> among the first group output bits PD01<0:3>, PDB01<0:3>, PD23<0:3>, PDB23<0:3>, PD45<0:3>, and/or PDB45<0:3>.

When the number of gray-scale voltages V<0:63> that the first group sub decoders 25-1 through 25-P receive is 64, each of the first group sub decoders 25-1 through 25-P may output one of four gray-scale voltages in response to the first bits PD01<0:3> and/or PDB01<0:3> and the number of the first group sub decoders 25-1 through 25-P may be 16. For instance, among the first group sub decoders 25-1 through 25-P, the first sub decoder 25-1 may output one of the four gray-scale voltages V<60:63> in response to the first bits PD01<0:3> and/or PDB01<0:3>.

Figure 4:
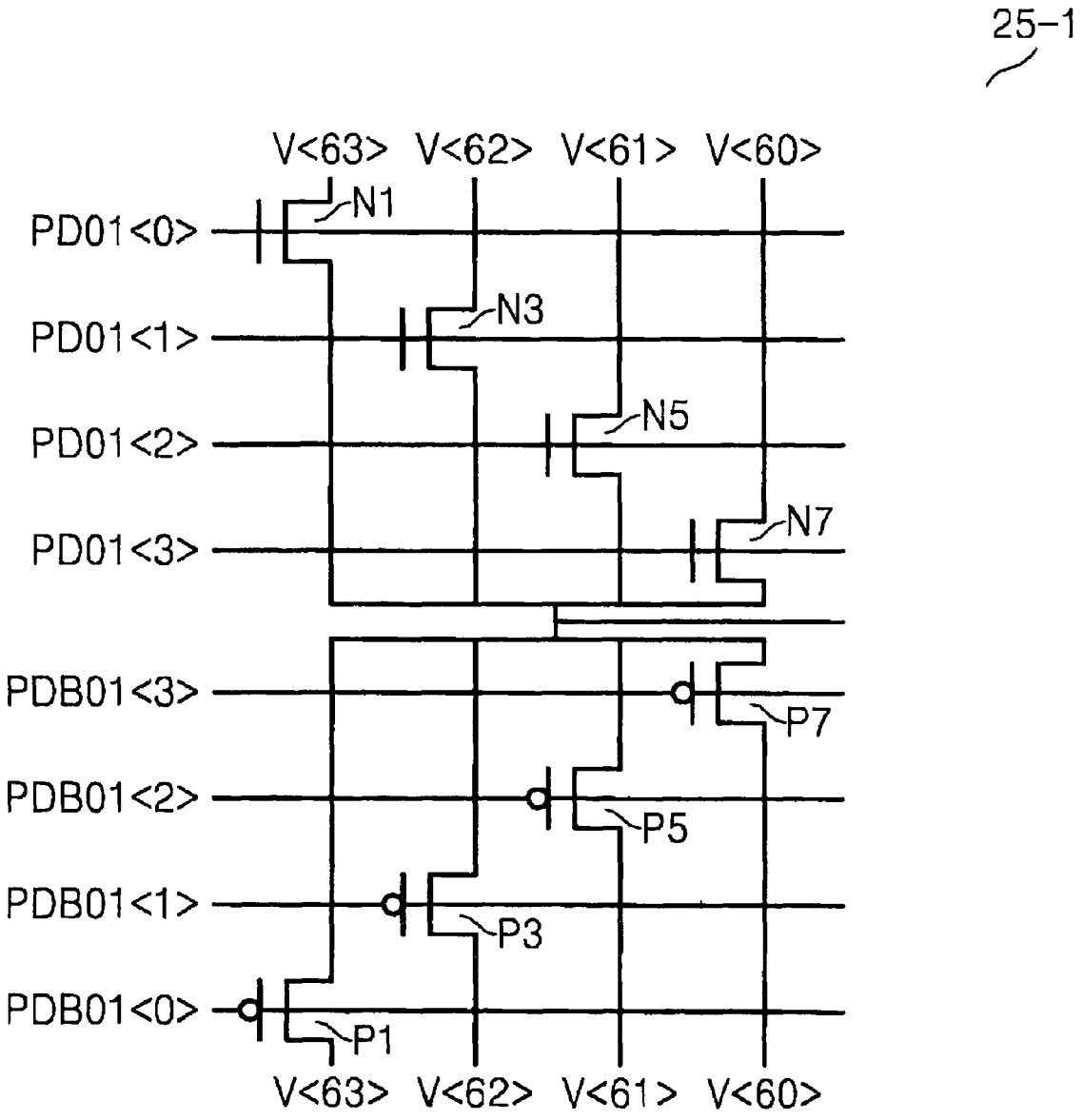
FIG. 4 is a circuit diagram of a sub decoder illustrated in FIG. 3.

FIG. 4 is a circuit diagram of the sub decoder 25-1 illustrated in FIG. 3. Since the other sub decoders 25-2 through 25-P, 27-1 through 27-Q, and 29 have the same structure and/or functions as the sub decoder 25-1, detailed descriptions thereof will be omitted. Referring to FIGS. 1A through 1C and FIGS. 3 and 4, the sub decoder 25-1 includes a plurality of switches N1, N3, N5, N7, P1, P3, P5, and P7, which operate in response to corresponding bits, i.e., the first bits PD01<0:3> and PDB01<0:3> among the first group output bits PD01<0:3>, PDB01<0:3>, PD23<0:3>, PDB23<0:3>, PD45<0:3>, and PDB45<0:3> and output one among the plurality of gray-scale voltages V<60:63>.

Among the switches N1, N3, N5, N7, P1, P3, P5, and P7, first group switches N1 through N7 are respectively gated in response to first through fourth bits PD01<0:3> to select and/or output one gray-scale voltage among first through fourth gray-scale voltages V<63>, V<62>, V<61>, and/or V<60>. Second group switches P1 through P7 are respectively gated in response to fifth through eighth bits PDB01<0:3> to select and/or output one gray-scale voltage among the first through fourth gray-scale voltages V<63> through V<60>. At this time, the first group switches N1 through N7 may be implemented by N-type transistors and/or the second group switches P1 through P7 may be implemented by P-type transistors. The signal levels of the first through fourth bits PD01<0:3> may be complementary to those of the fifth through eighth bits PDB01<0:3>.

Referring back to FIG. 3, the second group sub decoders 27-1 through 27-Q may select and/or output some gray-scale voltages among gray-scale voltages received from the first group sub decoders 25-1 through 25-P in response to the second bits PD23<0:3> and/or PDB23<0:3> among the first group output bits PD01<0:3>, PDB01<0:3>, PD23<0:3>, PDB23<0:3>, PD45<0:3>, and/or PDB45<0:3>. When the number of gray-scale voltages V<0:63> received by the first group sub decoders 25-1 through 25-P is 64, each of the second group sub decoders 27-1 through 27-Q may receive four voltages respectively output from four sub decoders among the first group sub decoders 25-1 through 25-P and may output one of the four received voltages. At this time, the number of the second group sub decoders 27-1 through 27-Q may be 4. For instance, the first sub decoder 27-1 among the second group sub decoders 27-1 through 27-Q may select and/or output one voltage among four output voltages respectively from the first through fourth sub decoders 25-1, 25-3, 25-5, and 25-7 among the first group sub decoders 25-1 through 25-P in response to the second bits PD23<0:3> and PDB23<0:3>.

The third group sub decoder 29 may select and/or output one gray-scale voltage among gray-scale voltages output from the second group sub decoders 27-1 through 27-Q in response to the third bits PD45<0:3> and/or PDB45<0:3> among the first group output bits PD01<0:3>, PDB01<0:3>, PD23<0:3>, PDB23<0:3>, PD45<0:3>, and/or PDB45<0:

3>. When the number of gray-scale voltages V<0:63> received by the first group sub decoders 25-1 through 25-P is 64, the third group sub decoder 29 may select and/or output one voltage among the output voltages of the second group sub decoders 27-1 through 27-Q.

Referring back to FIGS. 1A through 1C, the decoder 15-1 may select and/or output one gray-scale voltage Samp_IN1 among the gray-scale voltages V6<0> through V6<3> respectively output from the sub decoding blocks 13-1 through 13-4 based on one or more final selection bits, e.g., D<7:6> among the bits of the second image data or the level-shifted bits thereof The source driver amplifier 21-1 may buffer the gray-scale voltage Samp_IN1 output from the decoder 15-1 and output an analog voltage corresponding to the first image data as a buffering result to the source line. The source driver amplifier 21-1 may be implemented by a unit gain buffer or an operational amplifier.

Figure 5A:
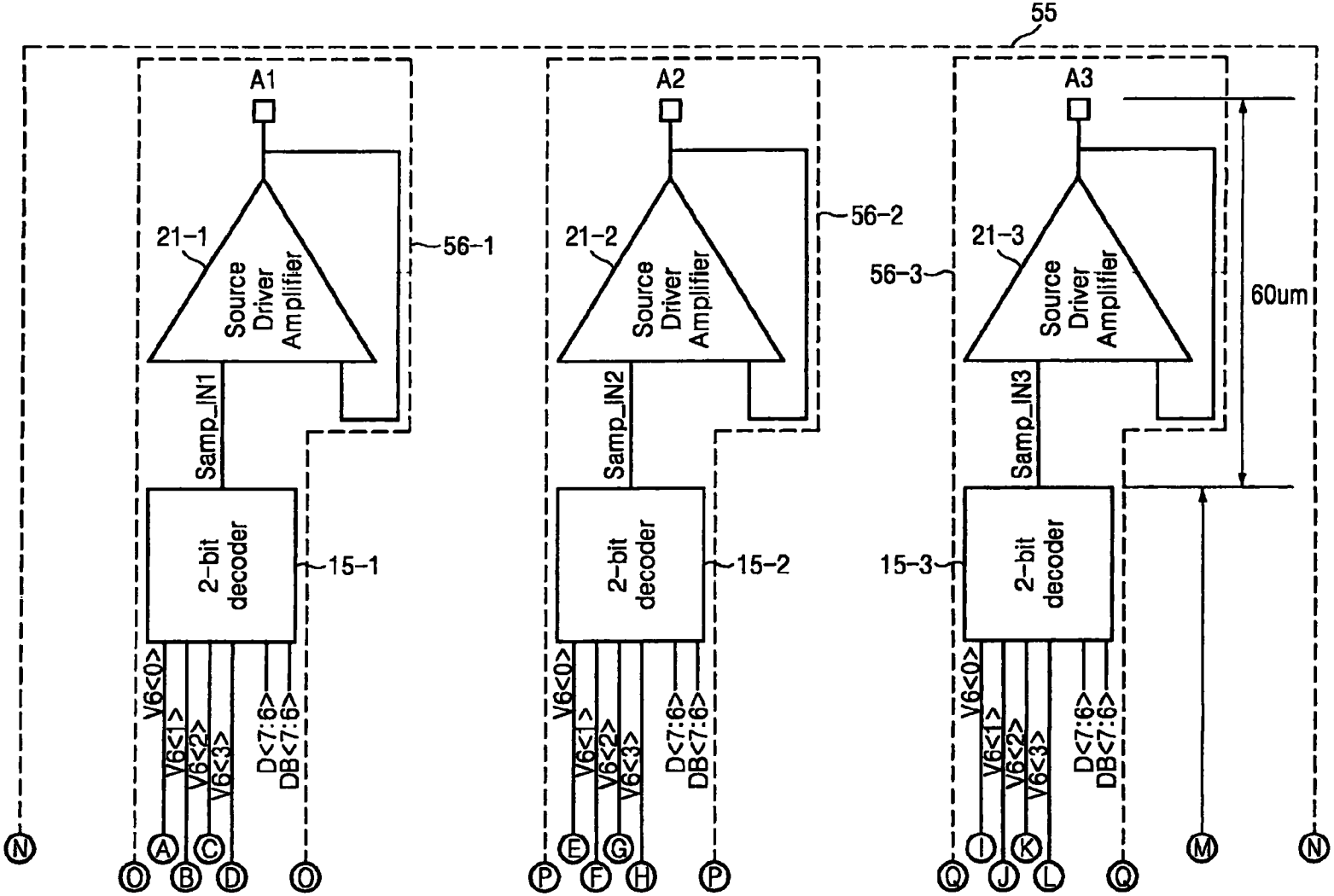
FIGS. 5A and 5B are block diagrams illustrating a source line driver circuit as a comparison to example embodiments.
Figure 5B:
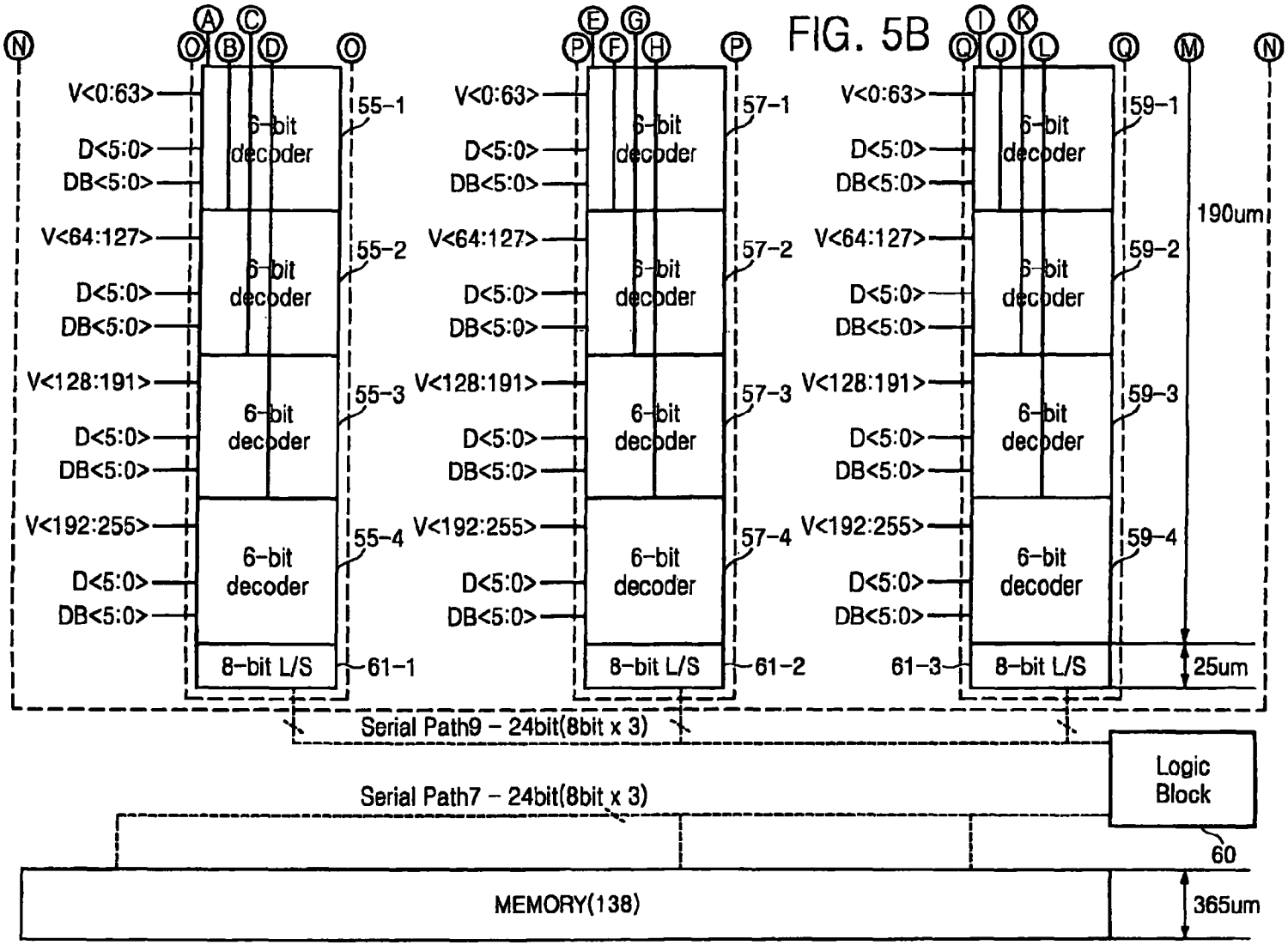
Figure 6:
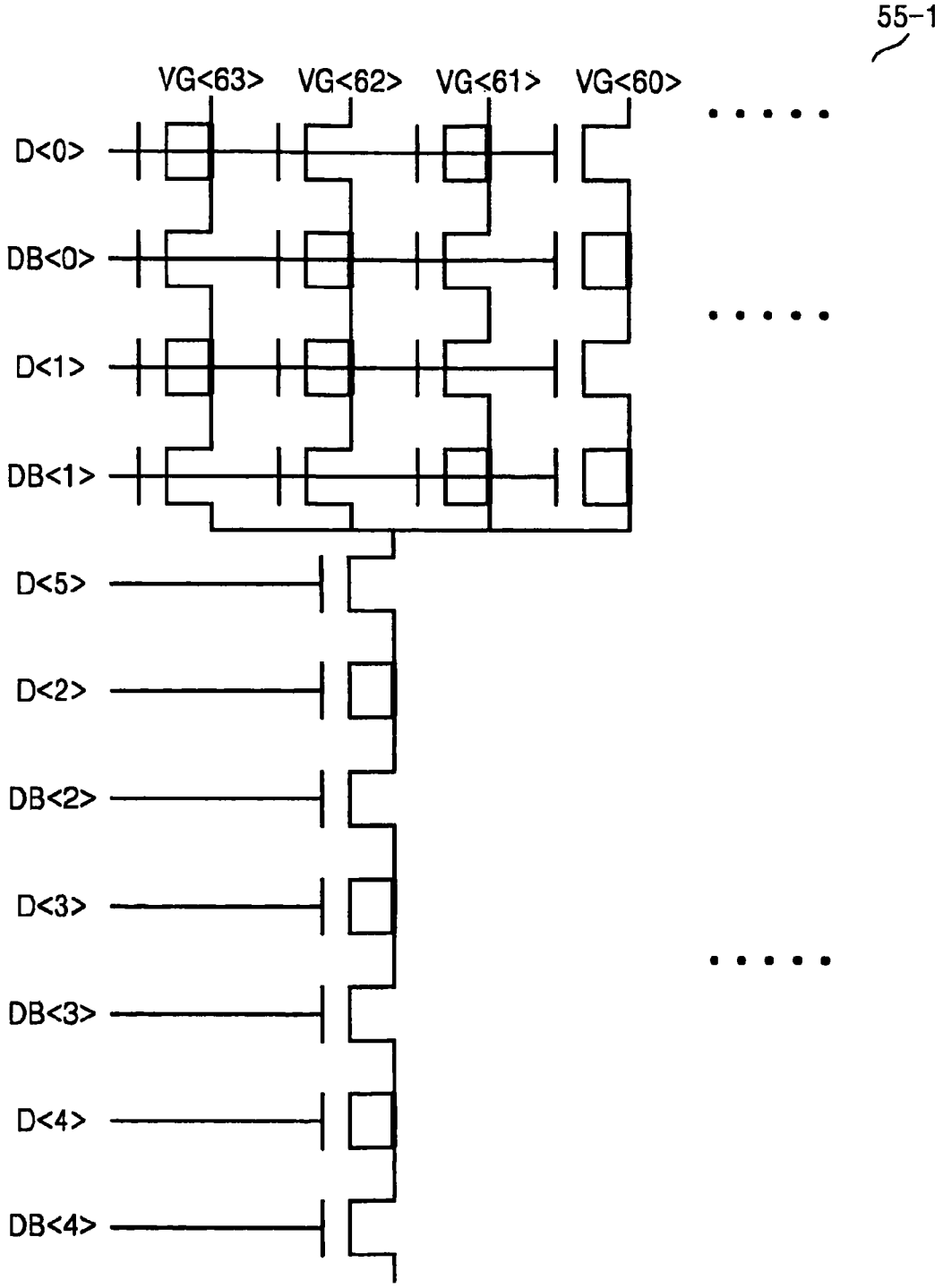
FIG. 6 is a circuit diagram of a sub decoder block illustrated in FIGS. 5A and 5B.

FIGS. 5A and 5B are block diagrams illustrating a source line driver circuit as a comparison example embodiments. FIG. 6 is a block diagram of a sub decoder block 55-1 illustrated in FIGS. 5A and 5B. Referring to FIGS. 5A through 6, the source line driver circuit includes a logic block 60 and a source channel driver unit 55.

The logic block 60 may receive serialized image data in units of N (e.g., 8) bits from the memory unit 138 through a first transmission line Serial Path7. Next, the logic block 60 may output the image data to one source channel driver (e.g., 56-1) among a plurality of source channel drivers 56-1, 56-2, and/or 56-3 through a second transmission line Serial Path9 without changing the number of bits.

Among the source channel drivers 56-1 through 56-3, the first source channel driver 56-1 may shift the level of N (e.g., 8) bit image data using a level shifter 61-1. The first source channel driver 56-1 may include a plurality of sub decoding blocks 55-1 through 55-4. The sub decoding blocks 55-1 through 55-4 may output gray-scale voltages V6<0> through V6<3>, respectively, among a plurality of gray-scale voltages V<0:255> in response to bits (e.g., D<5:0> and/or DB<5:0>) of image data output from the level shifter 61-1.

Each of the decoders 15-1 through 15-3 may select and/or output one gray-scale voltage among the gray-scale voltages V6<0> through V6<3> output from the sub decoding blocks (e.g., 55-1 through 59-4) in response to selection bits D<7:6> and/or DB<7:6> included in the image data. In the comparison example, each sub decoding block, e.g., 55-1, includes a plurality of transmission transistors, as illustrated in FIG. 6.

For instance, when each sub decoding block has the structure illustrated in FIG. 6, the sub decoding blocks 55-1 through 55-4 need 900 transmission transistors, which may be the number of transmission transistors in each sub decoding block (225) multiplied by the number of the sub decoding blocks 55-1 through 55-4 (4). This may increase the area of a display driver IC (DDI), (e.g., a mobile DDI). Since transmission transistors play the role of resistors in the DDI, current consumption may also increase.

In comparison, according to example embodiments, the logic block 50 may change serialized N (e.g., 8) bit image data into M (e.g., 14) bit image data. Next, each of the sub decoding blocks 13-1 through 13-4 may output at least one gray-scale voltage (e.g., V6<0>, V6<1>, V6<2>, or V6<3>) among a plurality of gray-scale voltages V<0:255> using the sub decoders 25-1 through 29 shown in FIGS. 3 and 4 in response to the M-bit image data. At this time, when each of the sub decoders 25-1 through 29 has the structure illustrated in FIG. 4, the number of transmission transistors required in the sub decoding blocks 13-1 through 13-4 is 336, which may be the number of transmission transistors in each sub decoder (4) multiplied by the number of the sub decoders 25-1 through 29 (21), further multiplied by the number of the sub decoding blocks 13-1 through 13-4 (4).

In other words, as compared to the comparison example, a source line driver circuit according to example embodiments may reduce the number of transmission transistors needed for decoding, thereby reducing the area of a DDI and/or current consumption. For instance, while the decoder 15-1 and/or the sub decoding blocks 55-1 through 55-4 in the source channel driver 56-1 shown in FIGS. 5A and 5B occupy a length of 190 μm, the decoder 15-1 and/or the sub decoding blocks 13-1 through 13-4 in the source channel driver 10-1 shown in FIGS. 1A through 1C occupy a length of 100 μm or less. Thus, the length of a source driver channel may be decreased in the example embodiments.

Figure 7:
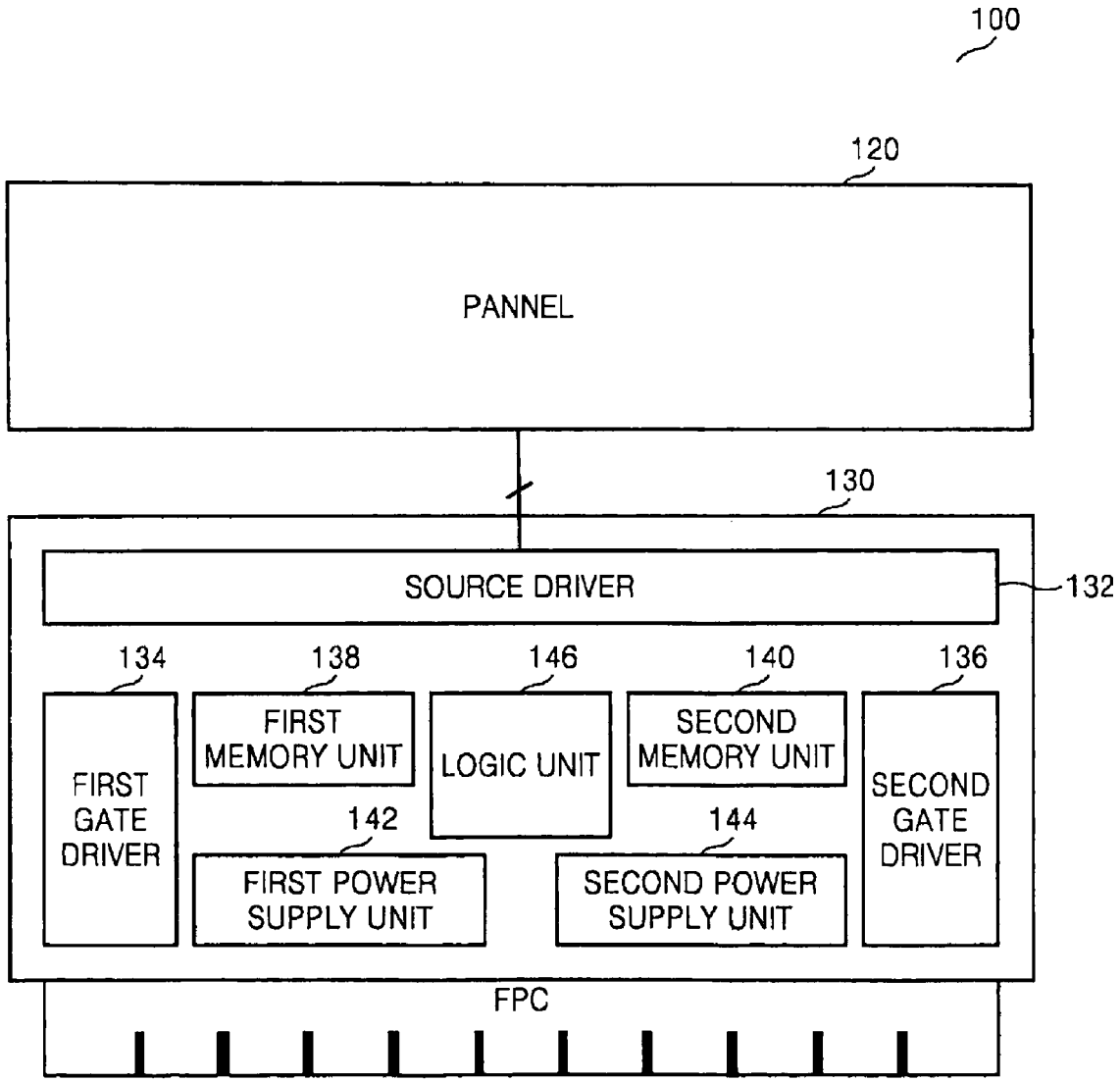
FIG. 7 is a block diagram of a display apparatus according to example embodiments.

FIG. 7 is a block diagram of a display apparatus 100 according to example embodiments. Referring to FIGS. 1A through 1C and FIG. 7, the display apparatus 100 includes a thin film transistor liquid crystal display (TFT-LCD) panel 120 and a display panel driver 130.

The TFT-LCD panel 120 may include a plurality of source (or data) lines (not shown), a plurality of gate (or scan) lines (not shown), and/or a plurality of pixels (not shown). A display panel driver 130 drives the plurality of source lines and/or the plurality of gate lines and the TFT-LCD panel 120 displays an image through the plurality of pixels.

The display panel driver 130 includes a source driver 132, a first gate driver 134, a second gate driver 136, a first memory unit 138, a second memory unit 140, a first power supply unit 142, a second power supply unit 144, and a logic unit 146. The source driver 132 may drive one of the source lines in the TFT-LCD panel 120 based on at least one voltage generated by the first or second power supply unit 142 or 144. The operation and the structure of the source driver 132 have been described in detail with reference to FIGS. 1A through 6.

Each of the first and/or second gate drivers 134 and 136 may drive one of the gate lines in the TFT-LCD panel 120 based on at least one voltage generated by the first or second power supply unit 142 or 144. For instance, the first gate driver 134 may drive a first gate line among first group gate lines included in a first region (not shown) of the TFT-LCD panel 120, which is divided into K (which is a natural number, e.g., 2) regions. The second gate driver 136 may drive a second gate line among second group gate lines included in a second region (not shown) of the TFT-LCD panel 120, which is divided into K (e.g., 2) regions. The first and/or second gate drivers 134 and 136 may be integrated into a single gate driver.

The first and/or second memory units 138 and 140 may store data displayed on the TFT-LCD panel 120 and/or software for operating the logic unit 146. The first and/or second memory units 138 and 140 may be integrated into a single memory unit and/or they may be implemented using graphic random access memory (GRAM).

The logic unit 146 may control the operations of: (i) the source driver 132, (ii) the first gate driver 134 and/or second gate drivers 136, (iii) the first memory unit 138 and/or second memory unit 140, and/or (iv) the first supply unit 142 and/or the second power supply unit 144.

Figure 8:
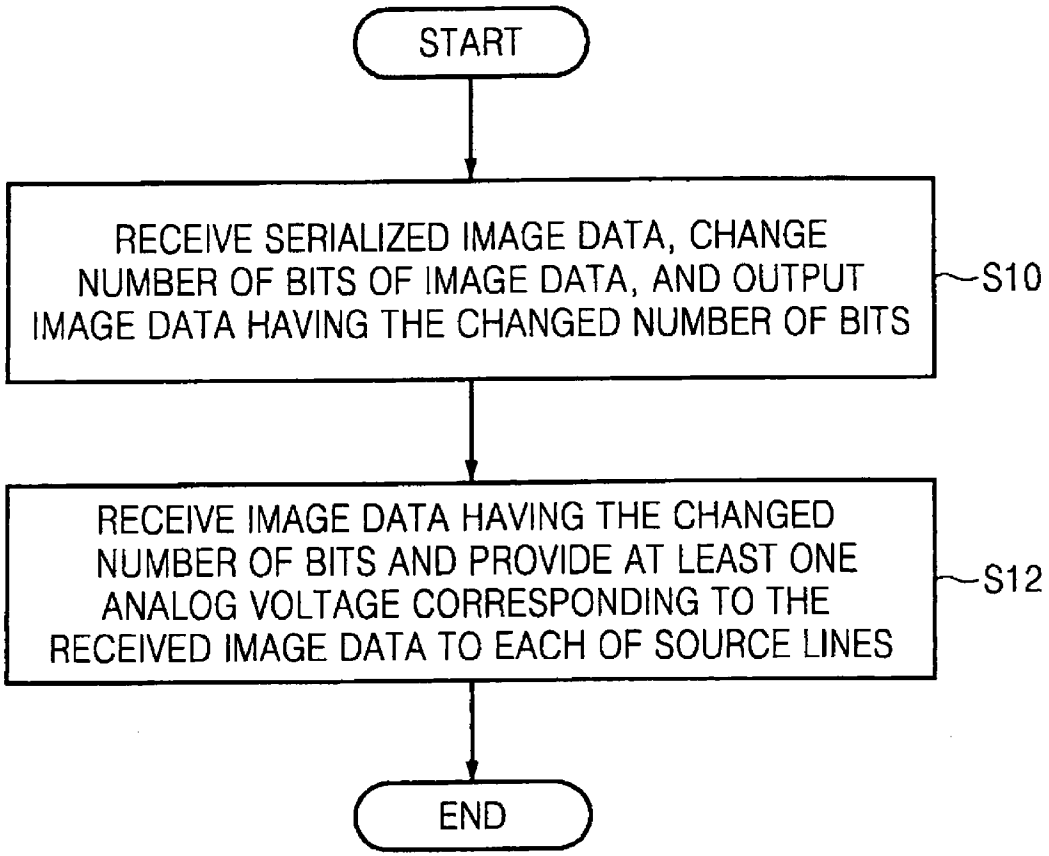
FIG. 8 is a flowchart of a source line driving method according to example embodiments.

FIG. 8 is a flowchart of a source line driving method according to example embodiments. Referring to FIGS. 1A through 1C and FIG. 8, the logic block 50 receives serialized N (e.g., 8) bit image data, changes the number of bits of the image data, and outputs image data having the changed number of bits (e.g., M (e.g., 14) bits) in operation S10. The source channel driver unit 10 receives the image data having the changed number of bits and provides at least one analog voltage corresponding to the received image data to each of source lines in operation S12.

As described above, according to example embodiments, the number of switches needed in a source line driver circuit is reduced, so that the area and the current consumption of the source line driver circuit may be reduced.

While the present discussions and illustrations are described with reference to example embodiments, it will be understood by those of ordinary skill in the art that various changes in forms and/or details may be made therein without departing from the spirit and scope of the subject matter as defined by the following claims.

What is claimed is:

1. A source line driver circuit comprising:

a logic block configured to, receive serialized first image data corresponding to an analog voltage provided to a first source line among the source lines, increase the number of bits of the first image data, and output second image data having the increased number of bits; and a source channel driver unit configured to receive the second image data having the increased number of bits and to provide at least one analog voltage corresponding to the received second image data to source lines, the source channel driver unit including at least one source channel driver configured to, based on the second image data, select one gray-scale voltage among a plurality of gray-scale voltages and provide the analog voltage corresponding to the first image data to the first source line, wherein the at least one source channel driver includes, a level shifter configured to shift a signal level of each of the bits of the second image data, a plurality of sub decoding blocks each configured to output at least one gray-scale voltage among the plurality of gray-scale voltages based on first group bits among bits output from the level shifter, a decoder configured to select one gray-scale voltage among the at least one gray-scale voltage output from the plurality of sub decoding blocks based on at least one final selection bit among at least one of the bits of the second image data and the bits output from the level shifter, and an amplifier configured to buffer the gray-scale voltage output from the decoder and output a buffering result as the analog voltage corresponding to the first image data to the source line.

2. The source line driver circuit of claim 1, wherein each of the bits of the second image data is used by the source channel driver as a switching signal for selecting one gray-scale voltage.

3. The source line driver circuit of claim 1, wherein each of the sub decoding blocks includes a plurality of sub decoders each of which selects and outputs one gray-scale voltage among the plurality of gray-scale voltages in response to at least one bit among the first group bits.

4. The source line driver circuit of claim 3, wherein the plurality of sub decoders include, a plurality of first group sub decoders configured to select and output first group gray-scale voltages among the plurality of gray-scale voltages based on first bits among the first group bits, a plurality of second group sub decoders configured to select and output second group gray-scale voltages among the first group gray-scale voltages output from the first group sub decoders based on second bits among the first group bits, and a third group sub decoder configured to select and output one gray-scale voltage among the second group gray-scale voltages output from the second group sub decoders based on third bits among the first group bits.

5. The source line driver circuit of claim 3, wherein each of the first through third sub decoders comprises:

a plurality of switches each operating and outputting one gray-scale voltage among the plurality of gray-scale voltages in response to one bit among the first group bits.

6. A display apparatus comprising:

a display panel including at least one of a plurality of scan lines and a plurality of source lines; and a panel driver including a source line driver circuit for driving the source lines, the source line driver circuit including, a logic block configured to, receive serialized first image data corresponding to an analog voltage provided to a first source line among the source lines, increase the number of bits of the first image data, and output second image data having the increased number of bits, and a source channel driver unit configured to receive the second image data having the increased number of bits and to provide at least one analog voltage corresponding to the received image data to source lines, the source channel driver unit including at least one source channel driver configured to, based on the second image data, select one gray-scale voltage among a plurality of gray-scale voltages and provide the analog voltage corresponding to the first image data to the first source line, wherein the at least one source channel driver includes, a level shifter configured to shift a signal level of each of the bits of the second image data, a plurality of sub decoding blocks each configured to output at least one gray-scale voltage among the plurality of gray-scale voltages based on first group bits among bits output from the level shifter, a decoder configured to select one gray-scale voltage among the at least one gray-scale voltage output from the plurality of sub decoding blocks based on at least one final selection bit among at least one of the bits of the second image data and the bits output from the level shifter, and an amplifier configured to buffer the gray-scale voltage output from the decoder and output a buffering result as the analog voltage corresponding to the first image data to the source line.

7. The display apparatus of claim 6, wherein each of the bits of the second image data is used by the source channel driver as a switching signal for selecting one gray-scale voltage.

8. The source line driver circuit of claim 1, wherein the logic block receives the serialized first image data from a memory unit.

9. The source line driver circuit of claim 3, wherein the each of the plurality of sub decoding blocks includes a plurality of switches.

10. The source line driver circuit of claim 9, wherein the each of the switches is a transistor.

* * * * *